United States Patent [19]

Josenhans

[11] 4,082,270

[45] Apr. 4, 1978

[54] BILLIARD BANKING AID

[76] Inventor: Frederick G. Josenhans, 14020 Netherfield Dr., Midlothian, Va. 23113

[21] Appl. No.: 681,550

[22] Filed: Apr. 29, 1976

[51] Int. Cl.[2] ..... A63D 15/00

[52] U.S. Cl. ..... 273/2

[58] Field of Search ..... 273/2, 14; 33/289; 35/29 R

[56] References Cited

U.S. PATENT DOCUMENTS

| | | | |
|---|---|---|---|
| 2,537,228 | 1/1951 | Matson | 273/14 UX |
| 2,711,319 | 6/1955 | Morgan et al. | 273/149 R |

*Primary Examiner*—Anton O. Oeschsle

*Attorney, Agent, or Firm*—Norman B. Rainer

[57] ABSTRACT

A training device for determining the theoretical point to aim a billiard ball at a billiard table cushion when attempting a bank shot.

3 Claims, 3 Drawing Figures

BILLIARD BANKING AID

BACKGROUND OF THE INVENTION

This invention pertains to a training aid device for use in increasing a player's ability in the game of billiards, which name in all of the following includes the game of pocket billiards. This invention pertains specifically to the aspect of the game referred to as "banking" which is the rolling of a ball into a limit of the game table known as a cushion for the purpose of having the ball return from such cushion along a desired path on the table. The ability to direct the ball into the cushion at such a point and in such a manner that the path of its roll from the cushion may be predicted is a desirable ability in billiard games.

Many players of low or fair ability incorrectly believe that a desired "banking" will result if the ball is directed to the cushion edge at that point at which the acute angle of the imaginary line between the ball and the point on the cushion is equal to the acute angle of the imaginary line between the desired destination and the same point on the cushion. This would be essentially true if the cushion were of a polished and inflexible material such as ivory. This is not true to varying degrees because the cushion is felt covered rubber, which allows two factors to affect the angle at which the ball returns from the cushion. The rubber cushion is compressed when the ball hits it, and in returning to its normal configuration will deflect the ball from its theoretical bank line an amount related to the speed of the ball when it hits the cushion. The second factor is that any spin which the ball has causes the felt on the cushion to grab the ball during this contact and to deflect the ball from its theoretical bank line, an amount related to the angle of the ball's approach to the cushion, the speed of the spin, and the direction of the spin. Thus by combination of speed and spin effects the ball may bank at either a higher or lower angle than the theoretical.

Three conventional methods of determining the theoretical banking point are: attempting to imagine the equal acute angles previously described; attempting to use "diamonds" which are equally spaced markers on the table rail behind the cushions, in which case a mental calculation of some difficulty is required; using a protractor to describe the angles of the banking point on the table in chalk. The present invention is superior to these methods as it does not require an ability to imagine the angles, an ability to calculate, the ability to read a protractor, nor does it require marking the table.

A basic object of the device is to provide a means of simply, quickly and accurately locating the theoretical banking point on the cushion for a ball in any location on the table which ball is desired to be banked to a specific location such as a pocket.

A second object of the device is to provide both a rapid means of adjustment for various angles of banking and at the same time one which may be used correctly with a minimum of training and adjustment ability.

A third object of the device is to provide a means for analysis of the effect of various speeds and spins imparted to the ball, to the actual direction of the ball on leaving the cushion.

A fourth object of the device is to assist the player in improving his proficiency in understanding where the ball must be aimed relative to the theoretical banking point when various options of ball speed and spins are used, all in order for the ball to follow a desired path from the cushion in a bank shot. A further object of the device is to provide an inexpensive device for the improvement of a player's ability to bank a ball in a billiard game.

BRIEF DESCRIPTION OF THE DRAWINGS

These and other objects of the invention arising from detals thereof will be apparent from the following description and accompanying drawings, wherein.

Similar characters of reference indicate similar or identical elements and portions throughout the specifications and throughout the views of the drawings.

DETAILED DESCRIPTION OF THE INVENTION

Figure 1:
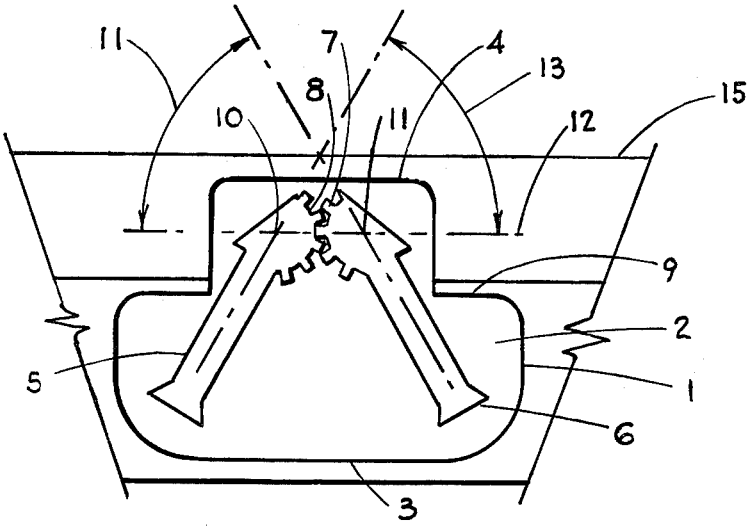
FIG. 1 is a plan view of a billiard banking aid of three piece construction located on a billiard table.
Figure 2:
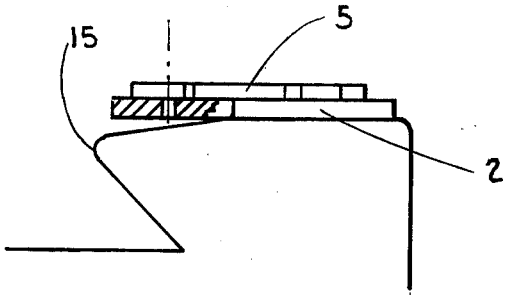
FIG. 2 is a side view of a billiard banking aid located on a billiard table and showing a portion of the table surface.

Referring now to FIGS. 1 and 2 of the drawings, the device 1 comprises a base 2 on which are mounted two moveable pointers 5 and 6 which have integral and meshing gear surfaces 7 and 8 arranged such that the angle 13 of said pointer 5 with a line 12 through the pivot points 10 and 11 of the pointers, is equal and opposite to the angle 14 of said pointer 6 with said line 12.

Base 2 is of a rigid material and pointers 5 and 6 are of rigid material. Base Plate 2 is provided with holes at pivot points 10 and 11 which receive mating pins appurtenant to pointers 5 and 6, said pins being coaxial to the pitch diameter of their respective gear surfaces 7 and 8. Edges 3, 4 and 9 are parallel to line 12 for visual alignment of the device 2 with respect to the edge of the cushion 15.

Figure 3:
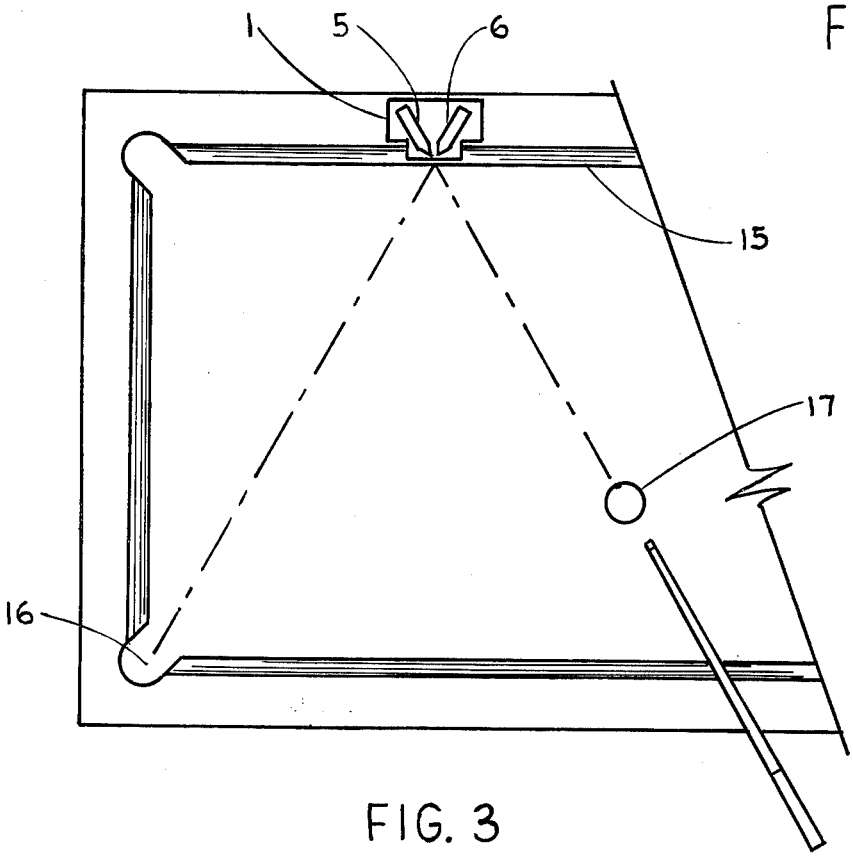
FIG. 3 is a plan view showing the billiard banking aid located on the cushion of a billiard table, a portion of the table surface, a billiard ball and cue stick in their relative positions to the aid and the theoretical angles of the path of the ball to and from the cushion.

Referring now to FIG. 3 of the drawings, the device 1 is positioned by the user so that the line 12 through the pivot points 10 and 11 is parallel to the edge of cushion 15, with pointer 6 pointing to the target pocket 16 and with the intersection of the pointers' axes coincident with the edge of the cushion 15. The ball 17 to be banked is placed on the imaginary line indicated by pointer 5.

I claim:

1. A device for training in banking skill in the game of billiards comprising:

a. a substantially flat, rigid base having at least one straight edge and two holes, said straight edge disposed in parallel relationship to the line connecting the centers of said two holes, b. two essentially flat elongated pointers of substantially mirror-image structural identity, each rotatably supported above said base by a pivot pin engaging with one of said holes, and containing adjacent its forward pointing extremity a series of gear teeth disposed in an arcuate path whose center of curvature coincides with said pivot pin, said pointers being positioned in opposed coplanar relationship causing mating of said teeth such that, at any acute angle of the longitudinal axis of one pointer with said line, the opposed pointer will present an acute angle of equal value on the same side of said line but in the opposite direction, and c. means for retaining said pivot pins within said holes.

2. The device of claim 1 wherein said straight edge is positioned in said base forward of said line and the forward pointing extremities of said pointers.

3. The device of claim 2 wherein the positioning of said pointers and the proportionate sizes of said pointers and said base are such that the forward ends of said pointers do not extend beyond the forward end of said base, and said pointers do not intersect in any of their rotative positions.

* * * * *